US009611437B2

(12) United States Patent
Ji et al.

(10) Patent No.: US 9,611,437 B2
(45) Date of Patent: Apr. 4, 2017

(54) PRODUCING LOW METHANE SYNGAS FROM A TWO-STAGE GASIFIER

(75) Inventors: Shuncheng Ji, Katy, TX (US); Chancelor L. Williams, Katy, TX (US); Ron W. Herbanek, Katy, TX (US)

(73) Assignee: Lummus Technology Inc., Bloomfield, NJ (US)

( * ) Notice: Subject to any disclaimer, the term of this patent is extended or adjusted under 35 U.S.C. 154(b) by 652 days.

(21) Appl. No.: 12/985,051

(22) Filed: Jan. 5, 2011

(65) Prior Publication Data

US 2011/0168947 A1 Jul. 14, 2011

Related U.S. Application Data

(60) Provisional application No. 61/294,354, filed on Jan. 12, 2010.

(51) Int. Cl.

| | |
|---|---|
| ***C01B 3/24*** | (2006.01) |
| ***C10J 3/72*** | (2006.01) |
| ***C10J 3/52*** | (2006.01) |

(52) U.S. Cl.

CPC ..... *C10J 3/721* (2013.01); *C10J 3/526* (2013.01); *C10J 2300/1656* (2013.01)

(58) Field of Classification Search

None

See application file for complete search history.

(56) References Cited

U.S. PATENT DOCUMENTS

| | | | | |
|---|---|---|---|---|
| 4,468,376 | A | 8/1984 | Suggitt | |
| 4,781,731 | A | 11/1988 | Schlinger | |
| 5,866,091 | A | 2/1999 | Stevenson et al. | |
| 2003/0116472 | A1* | 6/2003 | Wieland et al. | 208/138 |
| 2006/0101715 | A1 | 5/2006 | Vlok et al. | |
| 2007/0051043 | A1 | 3/2007 | Schingnitz et al. | |
| 2008/0028680 | A1* | 2/2008 | Berggren et al. | 48/214 A |
| 2009/0038222 | A1* | 2/2009 | Douglas et al. | 48/73 |
| 2009/0126276 | A1 | 5/2009 | Johnson et al. | |
| 2009/0198090 | A1* | 8/2009 | Mamedov et al. | 585/324 |
| 2009/0199474 | A1* | 8/2009 | Leininger et al. | 48/69 |

FOREIGN PATENT DOCUMENTS

| | | | |
|---|---|---|---|
| WO | 03/022959 | A1 | 3/2003 |
| WO | 2008/113766 | A2 | 9/2008 |

OTHER PUBLICATIONS

Moon et al. (Doug Ju Moon, Jong Woo Ryu, Sand Deuk Lee and Byoung Sung Ahn, "Partial Oxidation (POX) Reforming of Gasoline for Fuel-Cell Powered Vehicles Applications", Korean J. Chem. Eng., 19(6), 921-927(2002).*

PCT/US11/20340 PCT International Search Report and Written Opinion (Form PCT/ISA/220) dated Mar. 8, 2011.

Extended European Search Report issued Jan. 2, 2017 in corresponding European application No. 11733212.2 (10 pages).

* cited by examiner

*Primary Examiner* — Jennifer A Smith
*Assistant Examiner* — Anita Nassiri Motlagh
(74) *Attorney, Agent, or Firm* — Osha Liang LLP

(57) ABSTRACT

The present disclosure relates generally to a method for obtaining synthesis gas from a gasifier that has a low methane content. The synthesis gas is obtained as an extraction gas from the quench section of the gasifier, and can be utilized as feedstock for a variety of chemical production processes without the need for expensive pre-treatment to remove methane.

16 Claims, 1 Drawing Sheet

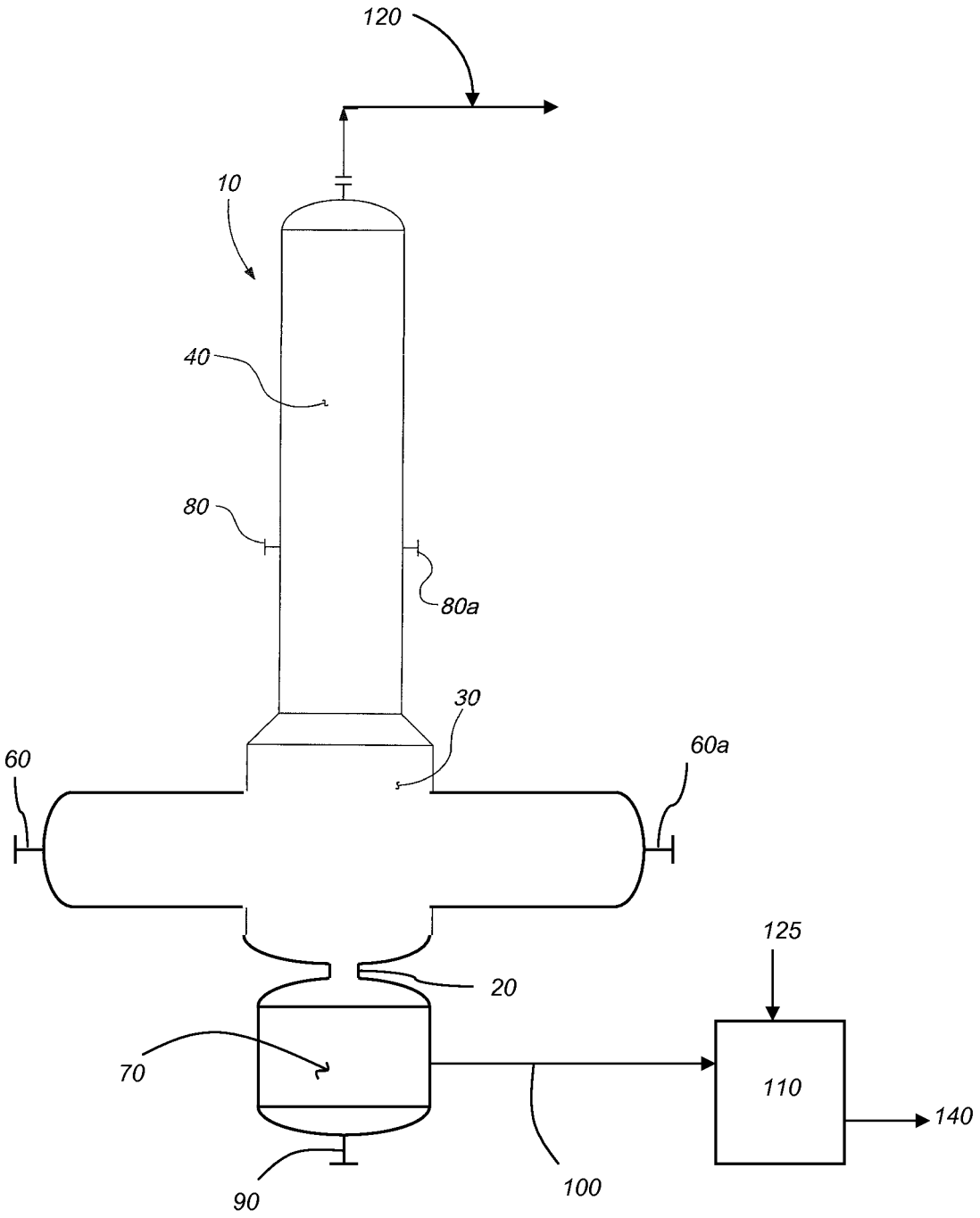
120
10
40
80
80a
30
60
60a
125
20
70
110
140
90
100

PRODUCING LOW METHANE SYNGAS FROM A TWO-STAGE GASIFIER

CROSS-REFERENCE TO RELATED APPLICATIONS

This application is a non-provisional application which claims benefit under 35 USC §119(e) to U.S. Provisional Application Ser. No. 61/294,354 filed Jan. 12, 2010, entitled "PRODUCING LOW METHANE SYNGAS FROM A TWO STAGE GASIFIER," which is incorporated herein in its entirety.

STATEMENT OF FEDERALLY SPONSORED RESEARCH

None.

FIELD OF THE DISCLOSURE

The present invention relates to a gasification process that converts carbonaceous feedstock into desirable gaseous products such as synthesis gas. More specifically, the present disclosure relates to an improvement that allows the production of synthesis gas from a gasification reactor that has a low methane concentration. The inventive process does not require expensive treatment of the syngas to remove excess methane prior to utilization of the syngas as a feedstock for the industrial-scale production of a variety of chemicals.

BACKGROUND

Gasification processes are widely used to convert solid or liquid feedstocks such as coal, petroleum coke and petroleum residue into synthesis gas. Synthesis gas is predominantly composed of hydrogen gas ($H_2$) and carbon monoxide (CO), and is utilized both as fuel for the production of electricity, as well as a feedstock for producing chemicals such as hydrogen, methanol, ammonia, synthetic/substitute natural gas or synthetic transportation oil. Synthesis gas produced via the gasification of carbonaceous material commonly contains some methane. The relative quantity of methane in the synthesis gas varies with the type of gasification system utilized, but is often observed to be higher in two-stage systems, such as ConocoPhillips E-Gas™ two-stage gasifier. Another example is the fixed-bed dry-bottom gasifier design of Lurgi GmbH (Frankfurt). In general, a significant amount of methane may be present in the syngas produced by any gasification system where the syngas leaves the reactor at a temperature of less than 2000° F.

The two-stage gasifier configuration has the benefit of a higher energy efficiency because a portion of the sensible heat in the hot synthesis gas leaving the first stage is utilized to gasify a portion of the feedstock added to the second stage in the absence of oxygen. Pyrolysis reactions dominate within the second stage and produce not just hydrogen and carbon monoxide, but also significant amounts of methane. Consequently, synthesis gas produced from a two-stage gasification reactor generally has a higher methane content than synthesis gas from most single-stage gasifier designs. For example, the synthesis gas produced in an E-Gas™ gasifier (ConocoPhillips Co.) usually contains between 1.5-4% methane (dry volume). This quantity of methane is not of significant concern when the synthesis gas produced is to be utilized as fuel for gas combustion turbines that generate electricity. However, this level of methane is not desirable when the synthesis gas is to be utilized as a feedstock for the production of chemicals, since $H_2$ and CO are the components of synthesis gas utilized as feedstock for these chemical production processes, and in some instances, the presence of methane is detrimental to the intended chemical production process. An example of this is the production of butyraldehyde, where the process requires a feedstock synthesis gas containing less than 0.6% methane (by volume).

Current chemical production methods utilizing synthesis gas with a high methane content as feedstock commonly require separation of the methane from the raw synthesis gas. The resulting methane-rich purge gas is sometimes combusted as a fuel gas, or converted to additional hydrogen and carbon monoxide via steam-reforming of the methane at high temperature and pressure in the presence of a catalyst. Alternatively, the methane may be removed by other processes, such as cryogenic lean-oil absorption. However, these processes are expensive to build and operate. Accordingly, there exists a need for improved technology that allows production of raw synthesis gas with a decreased methane content by any gasification reactor wherein the synthesis gas normally leaves the reactor at a temperature less than 2000° F. The invention described herein provides a unique process for providing a low-methane synthesis gas as a feedstock for chemical production processes without the need for expensive pre-treatment to remove methane.

BRIEF DESCRIPTION

In the present invention, there is provided a method for gasifying a carbonaceous feedstock. The method generally comprises partially oxidizing the feedstock in a gasification reactor, thereby producing a product gas comprising $H_2$, CO, and a small percentage of methane. The methane content of the product gas is generally between about 0.01% and 1.5% (dry volume), but preferentially is below 0.6%, as methane content above 0.6% may interfere with utilization of the product gas as feedstock for a number of chemical production processes.

Certain embodiments of the invention comprise a process that includes the following steps: a) providing a gasification reactor; b) partially oxidizing a carbonaceous feedstock in said reactor to produce a product gas comprising $H_2$, CO, and methane; c) extracting a portion of the product gas from an outlet in the quench section at the bottom of the gasifier to create an extraction gas, wherein said extraction gas has a reduced methane content relative to the product gas of step b); d) routing the extraction gas stream via a conduit to a chemical production process, wherein the extraction gas stream serves as carbonaceous feedstock for the production of chemicals. The percentage of methane in the extraction gas may be between about 0.01% and about 1.5% (by volume), but preferably, it is less than 0.6% (by volume).

In certain embodiments, the methane-depleted extraction gas stream is utilized as a feedstock for any of a variety of chemical production processes, such as, for example, a Fischer-Tropsch process, or a process for the production of methanol, methyl acetate, urea, urea ammonium nitrate, hydrogen gas, butyraldehyde, etc.

BRIEF DESCRIPTION OF THE DRAWINGS

Advantages of the present invention will become apparent to those skilled in the art with the benefit of the following description and upon reference to the accompanying drawing.

FIG. 1 is a schematic illustration in accordance with one embodiment of the current invention that depicts a two-stage gasification reactor, showing the relative positioning of the stages, as well as inlets for carbonaceous feed stock and an outlet for obtaining an extraction gas with a low methane content.

The invention is susceptible to various modifications and alternative forms, and a specific embodiment thereof is shown by way of example in the drawings. The drawings are not intended to be drawn to scale. It should be understood that the drawings and their accompanying detailed descriptions are not intended to limit the scope of the invention to the particular embodiments disclosed. Rather, the intention is to cover all modifications, equivalents and alternative embodiments falling within the spirit and scope of the present invention as defined by the appended claims.

DETAILED DESCRIPTION

The present invention is applicable to any gasification system wherein the temperature of the synthesis gas produced is normally less than 2000° F., and the methane content of the produced synthesis gas prevents its utilization as a feedstock for chemical production without first removing at least a portion of the methane. Such production processes may include, but are not limited to, a coal-to-liquids plant, or the production of hydrogen, ammonia, urea, methanol, or butyraldehyde.

The details of the gasification process are well-known in the art, and therefore, are described herein only in the detail required to fully disclose the present invention. In certain embodiments, the present invention builds upon the disclosures of U.S. Provisional Patent Applications 61/165,784, 61/138,312, 61/165,784, and 61/146,189, as well as U.S. patent application Ser. Nos. 12/192,471 and 11/834,751, which are all hereby incorporated by reference in their entirety.

In certain embodiments of the current invention, gasification is accomplished by partial combustion of a carbonaceous feedstock with air or high purity oxygen in a gasification reactor, creating hot synthesis gas predominantly comprising hydrogen and carbon monoxide, and also some methane. The residual mineral content of the carbonaceous feedstock forms a molten slag that is continuously removed from the gasifier. The hot synthesis gas created in a first reaction zone vaporizes and provides the heat required for the gasification of additional carbonaceous feedstock introduced into a second reaction zone. The synthesis gas exiting the gasification reactor is cooled and cleaned of particulates and chemical contaminants, and is then conditioned further prior to use either as fuel for a gas turbine, or as a feedstock for the production of chemicals. The process of the current invention relates to the use of the synthesis gas as feedstock for the production of chemicals.

While the application of the current invention is not limited to a two-stage gasification process, certain embodiments of the present invention provide a two-stage gasification reactor that comprises first and second reaction zones. FIG. 1 depicts a two-stage gasification reactor according to the E-Gas™ gasification reactor configuration owned by ConocoPhillips Co. The first reaction zone comprises a reactor lower-section 30, while the second reaction zone comprises a reactor upper-section 40. In FIG. 1, the unfired reactor upper-section 40 of the reactor 10 is directly attached to the top of the fired reactor lower-section 30 of the reactor 10 so that the hot reaction products of the first reaction zone are conveyed directly from the reactor lower-section 30 to the second reaction zone of the reactor upper-section 40, thereby minimizing heat loss.

Further referring to FIG. 1, the gasification process begins within the first reaction zone (or reactor lower-section 30), when a carbonaceous feedstock is mixed with a gas stream comprising an oxygen-containing gas and/or steam and a rapid exothermic reaction takes place in which the carbonaceous feedstock is converted into a first mixture product comprising steam, hydrogen, carbon monoxide, carbon dioxide, methane, and entrained particulates such as ash. Ash is comprised of the non-combustible mineral content of the carbonaceous feedstock. The temperature of the first reaction zone 30 is maintained higher than the ash melting point, which allows the ash to melt and agglomerate to form a viscous liquid known as slag. The slag falls to the bottom of the reactor lower-section 30 and flows through a taphole 20 and into a quench chamber 70, whereupon it is water-quenched and directed via an outlet 90 to a slag processing system (not shown) for final disposal.

The primary combustion reaction occurring in the first reaction zone is $$C + \frac{1}{2} O_2 \longrightarrow CO,$$

which is highly exothermic. It raises the temperature in the first reaction zone to between 2000° F. and 3500° F. The heat produced in the first reaction zone is carried upward with the gas stream, thereby providing heat for pyrolysis reactions that occur in the unfired second reaction zone, including vaporization of the feed water, the carbon-steam reaction and the water-gas reaction between CO and $H_2O$. The carbon-steam reaction forms CO and $H_2$, thus, increasing the yield of these usable gases.

In the embodiment shown in FIG. 1, a pulverized solid stream of carbonaceous feedstock is injected into the second reaction zone (or upper-section 40) through feeding device 80 and/or 80*a*. In certain alternative embodiments (not depicted), alternative feeding devices, such as, but not limited to, slurry feeding systems, can be utilized to add feedstock to the gasification reactor.

The physical conditions of the reaction in the second reaction zone (or reactor upper-section 40) are controlled to assure rapid gasification and heating of the feedstock above its range of plasticity. Once dispersed into the reactor upper-section, the feedstock comes into contact with the hot first mixture product rising from the first reaction zone (or reactor lower-section 30). The carbonaceous feedstock is dried as the water in the slurry turns to steam, and a portion of the feedstock is gasified via pyrolysis reactions such as the carbon steam reaction ($C+H_2O \rightarrow CO+H_2$) to produce hydrogen and carbon monoxide.

Further referring to FIG. 1, the raw gas stream exiting the gasification reactor via a conduit 120 may comprise one or more of the following: carbon monoxide (CO), carbon dioxide ($CO_2$), hydrogen ($H_2$), water ($H_2O$), methane ($CH_4$) and other light hydrocarbons, and nitrogen ($N_2$). Additionally, the raw gas stream can comprise one or more undesirable components (i.e., contaminants) that should be removed prior to utilizing the raw gas stream for the production of chemicals. Sulfur compounds, such as, for example, hydrogen sulfide ($H_2S$), carbonyl sulfide (COS), carbon disulfide ($CS_2$), and even organosulfur compounds such as mercaptans and various thiophenic compounds are a few examples of common contaminants found in the raw gas stream. Other examples of contaminants typically present in the raw gas stream can include, but are not limited to ammonia ($NH_3$), hydrochloric acid (HCl), and hydrogen cyanide (HCN). The high-temperature raw synthesis gas is cooled, and both particulates and acid gases are removed via methods that are commonly known to those skilled in the art and that are outside the scope of this document (not depicted). The resulting cleaned syngas can then be utilized as fuel to power a gas turbine, but for some chemical applications, excess methane must be removed prior to use of the syngas as feedstock any of a variety of chemical production processes.

Table 1, below, summarizes the composition of the raw synthesis gas stream according to certain embodiments of the present invention, wherein syngas is produced by a two-stage slurry-fed gasifier of the E-Gas™ configuration.

TABLE 1

| | Component in Raw Gas Stream (based on total stream volume) | | |
|---|---|---|---|
| Component | Broad Range | Intermediate Range | Narrow Range |
| $H_2$ | 8-50 vol % | 10-40 vol % | 15-35 vol % |
| CO | 10-75 vol % | 15-60 vol % | 25-50 vol % |
| $CO_2$ | 1-40 vol % | 5-30 vol % | 7-20 vol % |
| $H_2O$ | 4-40 vol % | 8-30 vol % | 10-25 vol % |
| $H_2S$ | 0.001-5 vol % | 0.1-2.5 vol % | 0.5-2 vol % |
| $CH_4$ | 0.05-10 vol % | 0.1 to 7.5 vol % | 0.5 to 5.0 vol % |
| COS | 100-5,000 ppmv | 200-2,500 ppmv | 350-1,500 ppmv |
| HCl | 50-2,000 ppmv | 100-1,500 ppmv | 250-1,000 ppmv |
| $NH_3$ | 50-2,000 ppmv | 100-1,500 ppmv | 250-1,000 ppmv |
| Other (total) | <2.5 vol % | <2.0 vol % | <1 vol % |

Table 1 shows that the raw syngas stream produced from the second reaction zone (or upper section 40) of the gasifier may contain a significant amount of methane (up to 10% by volume). Methane is not a useful feedstock component for many chemical synthesis processes that utilize the $H_2$ and CO components of synthesis gas as a starting material, and in some instances the presence of methane impedes the chemical synthesis.

Referring again to FIG. 1, established methods withdraw an extraction gas 100 from the quench chamber 70 in order to create a negative pressure that encourages the flow of molten ash from the gasification reactor through the taphole 20 and into the quench chamber 70. The negative pressure created by withdrawing the extraction gas also prevents plugging of the taphole by molten ash. According to established methodology, the extraction gas 100 is combined with the raw synthesis gas 120 obtained from the second reaction zone (upper section 40) upstream from the particulate removal system (not depicted).

However, the process of the present invention provides a process for obtaining syngas from a gasification reactor that has a methane content that is far lower than the methane content of the syngas produced in the second reaction zone (upper section 40). In certain embodiments, the methane content of the low-methane syngas obtained may be lower than about 1.5% (dry volume). Preferably, the methane content of the low-methane syngas obtained may be lower than about 0.6% (dry volume). Most preferably, the methane content of the low-methane syngas obtained may be lower than about 0.25% (dry volume). In the present invention, the extraction gas 100 is directed via a conduit to a wash drum 110. The wash drum contains an inlet for water 125, and washes the extraction gas to remove particulates. Methods and apparatus associated with such wash drums are commonly known to those skilled in the art. A particulate-free synthesis gas is produced 140 and can be utilized as feedstock for a variety of chemical production processes without further pretreatment.

EXAMPLE 1

According to the process of the current invention, an extraction gas 100 is obtained from an outlet in the quench chamber 70. This extraction gas comprises a synthesis gas that is much lower in methane content than the syngas emitted from the second reaction zone (upper stage 40) of the gasifier. An analysis was performed to determine the composition of the synthesis gases emitted from a two-stage slurry-fed E-Gas™ gasifier. Gas samples were taken from both the top of the second reaction zone 120, as well as an extraction gas outlet 100 in the quench chamber 70. The chemical composition of the two samples was analyzed, and the relative quantities of various gaseous components within each sample are presented in Table 2.

TABLE 2

| Component | Syngas From Second Reaction Zone (mol fraction) | Extraction Gas (mol fraction) |
|---|---|---|
| $N_2$ | 1.5% | 1.7% |
| Ar | 0.8% | 1.0% |
| $H_2$ | 35.3% | 32.3% |
| $CH_4$ | 2.7% | 0.1% |
| CO | 42.8% | 53.1% |
| $CO_2$ | 16.1% | 11.6% |
| $H_2S$ | 0.4% | 0.2% |
| $NH_3$ | 0.4% | 0.0% |
| Total | 100.0% | 100.0% |

Table 2 shows that the methane content of the synthesis gas obtained from the top of the second reaction zone had a much higher methane content (2.7%) than the extraction gas obtained from the quench chamber (0.1%) The extraction gas also had a reduced hydrogen sulfide and ammonia content. The extraction gas is then subjected to a simple cleaning procedure in a conventional wash drum to provide a particulate-free synthesis gas that is suitable for use as a feedstock for a variety of chemical production processes.

The process of the current invention is applicable to a variety of different chemical production processes (as described) that utilize the components of synthesis gas as a feedstock. In one embodiment of the of the present invention, petroleum coke produced by a refinery is utilized as a carbonaceous feedstock for a two-stage, slurry-fed gasification reactor. The syngas produced by gasification of the feedstock may serve as a source of hydrogen gas for certain refinery processes (such as hydrotreating, etc.) as well as a feedstock for any petrochemical unit that requires a low-methane syngas as its feedstock. One example is an "Oxo" Process, which involves the hydroformylation of propylene to butyraldehyde, where the main reaction is as follows:

$$CH_3CH{=}CH_2+CO+H_2 \rightarrow CH_3{-}CH_2{-}CH_2{-}CHO$$

This chemical synthesis process requires that the methane content of the syngas feedstock is less than 0.6% (dry volume), a requirement that is readily met by the reduced-methane extraction gas of the present invention (as shown in Table 2) without requiring expensive pre-treatment of the syngas to remove methane.

DEFINITIONS

For the purposes of this disclosure, the term "syngas" is synonymous with synthesis gas or synthetic gas, the term "gas" is synonymous with methane, natural gas, as well as gasoline or any other liquid hydrocarbon fuel.

For the purposes of this disclosure, use of the terms "low methane syngas" or "low-methane synthesis gas" refers to a syngas that has a methane content of 1.5% (dry volume) or less.

All gas composition percentages are expressed as dry volume unless indicated otherwise.

Further modifications and alternative embodiments of various aspects of the invention will be apparent to those skilled in the art in view of this description. Accordingly, this description is to be construed as illustrative only and is for the purpose of teaching those skilled in the art the general manner of carrying out the invention. It is to be understood that the forms of the invention shown and described herein are to be taken as examples of embodiments. Elements and materials may be substituted for those illustrated and described herein, parts and processes may be reversed and certain features of the invention may be utilized independently, all as would be apparent to one skilled in the art after having the benefit of this description of the invention. Changes may be made in the elements described herein without departing from the spirit and scope of the invention as described in the following claims.

We claim:

1. A process for comprising the following steps:

a) providing a gasification reactor that comprises at least one reaction zone having a first outlet and a quench section having a second outlet, wherein the quench section cools molten ash and removes it via the second outlet;

b) partially oxidizing a carbonaceous feedstock in the at least one reaction zone to produce a product gas comprising H2, CO, and methane, wherein a first portion of the product gas exits the reactor via the first outlet;

c) extracting a second portion of the product gas from a third outlet in the quench section of the gasifier, thereby producing an extraction gas comprising a reduced methane content relative to the product gas of step b);

d) routing the extraction gas to serve as carbonaceous feedstock for the production of chemicals.

2. The process of claim 1, wherein the extraction gas contains between about 0.01% and about 1.5% methane (by volume).

3. The process of claim 1, wherein the extraction gas contains less than about 0.6% methane (by volume).

4. The process of claim 1, wherein the extraction gas contains less than about 0.25% methane (by volume).

5. The process of claim 1, wherein the extraction gas is routed to a wash drum, wherein said wash drum utilizes water to remove particulates from the gas.

6. The process of claim 1, wherein the gasification reactor comprises a first reaction zone and a second reaction zone, and wherein a partial oxidation of the feedstock is the predominant reaction occurring within the first reaction zone, while pyrolysis of the feedstock is the predominant reaction occurring within the second reaction zone.

7. The process of claim 4, wherein the extraction gas is produced from said third outlet in the quench section immediately below the first reaction zone.

8. The process of claim 1, wherein the extraction gas is utilized as a feedstock for a chemical production process that may comprise a Fischer-Tropsch process, or a process for the production of methanol, ammonia, methyl acetate, urea, urea ammonium nitrate, butyraldehyde or hydrogen gas.

9. The process of claim 1, wherein the methane content of the product gas of part a) is between about 0.5% and 10% (dry volume).

10. A process comprising the following steps:

a) providing a gasification reactor that comprises a first reaction zone, a second reaction zone having a first outlet, and a quench section having a second outlet, wherein the quench section cools molten ash and removes it via the second outlet;

b) partially oxidizing a carbonaceous feedstock in the gasification reactor to produce a product gas comprising H2, CO, and methane, wherein a partial oxidation of the feedstock is the predominant reaction occurring within the first reaction zone, and wherein pyrolysis of the feedstock is the predominant reaction occurring within the second reaction zone;

c) extracting a portion of the product gas from a third outlet in the quench section of the gasification reactor, thereby producing an extraction gas comprising a reduced methane content relative to the product gas of step b);

d) routing the extraction gas to a wash drum that utilizes water to remove a majority of particulates from the extraction gas, thereby creating a cleaned extraction gas stream;

e) routing the cleaned extraction gas stream to serve as carbonaceous feedstock for the production of chemicals.

11. The process of claim 10, wherein the extraction gas contains between about 0.01% and about 1.5% methane (by volume).

12. The process of claim 10, wherein the extraction gas contains less than about 0.6% methane (by volume).

13. The process of claim 10, wherein the extraction gas contains less than about 0.25% methane (by volume).

14. The process of claim 10, wherein the gas stream is utilized as a feedstock for a chemical production process that may comprise a Fischer-Tropsch process, or a process for the production of methanol, ammonia, methyl acetate, urea, urea ammonium nitrate, butyraldehyde or hydrogen gas.

15. The process of claim 10, wherein the methane content of the product gas of part a) is between about 0.5% and 10% by weight.

16. The process of claim 10, wherein a portion of the product gas passes into the quench section of the gasification reactor and is extracted from the third outlet to produce the extraction gas without passing the portion through the second reaction zone.

* * * * *